US007659870B2

(12) United States Patent
Lee et al.

(10) Patent No.: US 7,659,870 B2
(45) **Date of Patent: *Feb. 9, 2010**

(54) METHOD OF DRIVING PLASMA DISPLAY PANEL

(75) Inventors: Jae Hong Lee, Taegu-shi (KR); Young Kyo Shin, Seoul (KR); Eun Cheol Lee, Kumi-shi (KR); Sung Yong Ahn, Kumi-shi (KR)

(73) Assignee: LG Electronics Inc., Seoul (KR)

( * ) Notice: Subject to any disclaimer, the term of this patent is extended or adjusted under 35 U.S.C. 154(b) by 422 days.

This patent is subject to a terminal disclaimer.

(21) Appl. No.: 11/266,193

(22) Filed: Nov. 4, 2005

(65) Prior Publication Data

US 2006/0092102 A1 May 4, 2006

Related U.S. Application Data

(63) Continuation of application No. 09/947,362, filed on Sep. 7, 2001, now Pat. No. 6,980,178.

(30) Foreign Application Priority Data

Sep. 8, 2000 (KR) ..... 10-2000-053514
Jan. 18, 2001 (KR) ..... 10-2001-003008
Feb. 1, 2001 (KR) ..... 10-2001-004744

(51) Int. Cl.
*G09G 3/28* (2006.01)

(52) U.S. Cl. ..... 345/60

(58) Field of Classification Search ..... 345/60, 345/37, 41, 63, 67, 68; 313/582, 484, 492, 313/584; 315/169.4, 169.1, 169.3
See application file for complete search history.

(56) References Cited

U.S. PATENT DOCUMENTS 4,002,828 A 1/1977 Nolan (Continued)

FOREIGN PATENT DOCUMENTS

JP 03-187125 8/1991

(Continued)

OTHER PUBLICATIONS

Japanese Search Report dated Feb. 19, 2008.

(Continued)

*Primary Examiner*—Abbas I Abdulselam
(74) *Attorney, Agent, or Firm*—KED & Associates, LLP

(57) ABSTRACT

A method of driving a plasma display panel that is adaptive for improving brightness and efficiency. In the method, a sustaining pulse for sustaining a discharge of a cell selected in a sustaining interval is alternately applied to each of a sustaining electrode pair. A pulse signal synchronized with the sustaining pulse is applied to a data electrode to cause a discharge for inducing a long-path discharge between the sustaining electrode pair between any one of the sustaining electrode pair and the data electrode.

9 Claims, 17 Drawing Sheets

U.S. PATENT DOCUMENTS

| | | | | |
|---|---|---|---|---|
| 4,067,047 | A | 1/1978 | Ryan | |
| 5,066,890 | A | 11/1991 | Salavin et al. | |
| 5,790,087 | A | 8/1998 | Shigeta et al. | |
| 6,020,687 | A | 2/2000 | Hirakawa et al. | |
| 6,208,082 | B1 | 3/2001 | Kim et al. | |
| 6,252,568 | B1 * | 6/2001 | Iseki et al. | 345/60 |
| 6,304,031 | B1 | 10/2001 | Wani et al. | |
| 6,456,265 | B1 | 9/2002 | Mikoshiba et al. | |
| 6,605,897 | B1 | 8/2003 | Yoo | |
| 6,980,178 | B2 * | 12/2005 | Lee et al. | 345/60 |

FOREIGN PATENT DOCUMENTS

| | | |
|---|---|---|
| JP | 3-219528 | 9/1991 |
| JP | 04-267293 | 9/1992 |
| JP | 05-232901 | 9/1993 |
| JP | 05-266800 | 10/1993 |
| JP | 07-105856 | 4/1995 |
| JP | 08-315735 | 11/1996 |
| JP | 09-081071 | 3/1997 |
| JP | 09-245627 | 9/1997 |
| JP | 09-283028 | 10/1997 |
| JP | 09-305142 | 11/1997 |
| JP | 10-149774 | 6/1998 |
| JP | 10-333636 | 12/1998 |
| JP | 10-333696 | 12/1998 |
| JP | 11-085099 | 3/1999 |
| JP | 11-143425 | 5/1999 |
| JP | 11-202831 | 7/1999 |
| JP | 2000-357462 | 4/2000 |
| JP | 2000-285814 | 10/2000 |
| JP | 2001-222956 | 8/2001 |
| KR | 1995-0007612 | 3/1995 |

OTHER PUBLICATIONS

Japanese Office Action dated Oct. 9, 2008 (Japanese text).
Japanese Office Action dated Aug. 5, 2009.

* cited by examiner

METHOD OF DRIVING PLASMA DISPLAY PANEL

This application is a continuation of U.S. application Ser. No. 09/947,362 filed Sep. 7, 2001, now U.S. Pat. No. 6,980, 178 the subject matter of which is incorporated herein by reference.

BACKGROUND OF THE INVENTION

1. Field of the Invention

This invention relates to a plasma display panel, and more particularly to a method of driving a plasma display panel that is adaptive for improving brightness and efficiency.

2. Description of the Related Art

Generally, a plasma display panel (PDP) radiates a fluorescent body by an ultraviolet with a wavelength of 147 nm generated during a discharge of He+Xe or Ne+Xe gas to thereby display a picture including characters and graphics. Such a PDP is easy to be made into a thin-film and large-dimension type. Moreover, the PDP provides a very improved picture quality owing to a recent technical development. Particularly, since a three-electrode, alternating current (AC) surface-discharge PDP lowers a voltage required for a discharge by utilizing wall charges accumulated in the surface thereof upon discharge and protects electrodes from a sputtering generated by the discharge, it has advantages of a low-voltage driving and a long life.

Referring to FIG. 1, a conventional three-electrode, AC surface-discharge PDP includes a scanning electrode Y and a sustaining electrode Z provided on an upper substrate 10, and a data electrode X provided on a lower substrate 18.

The scanning electrode Y and the sustaining electrode Z have transparent electrodes 12Y and 12Z with a large width and metal bus electrodes 13Y and 13Z with a small width, respectively, and are formed on the upper substrate in parallel. An upper dielectric layer 14 and a protective film 16 are disposed on the upper substrate 10 in such a manner to cover the scanning electrode Y and the sustaining electrode Z. Wall charges generated upon plasma discharge are accumulated in the upper dielectric layer 14. The protective film 16 prevents a damage of the upper dielectric layer 14 caused by a sputtering during the plasma discharge and improves the emission efficiency of secondary electrons. This protective film 16 is usually made from magnesium oxide (MgO). The data electrode X is perpendicular to the scanning electrode Y and the sustaining electrode Z.

A lower dielectric layer 22 and barrier ribs 24 are formed on the lower substrate 18. The surfaces of the lower dielectric layer 22 and the barrier ribs 24 are coated with a fluorescent material layer 26. The barrier ribs 24 separate adjacent discharge spaces in the horizontal direction to thereby prevent optical and electrical crosstalk between adjacent discharge cells. The fluorescent layer 26 is excited by an ultraviolet ray generated during the plasma discharge to generate any one of red, green and blue visible light rays. An inactive mixture gas of He+Xe or Ne+Xe is injected into a discharge space defined between the upper and lower substrate 10 and 18 and the barrier rib 24.

Discharge cells of the three-electrode PDP are arranged at a panel 30 in a matrix pattern as shown in FIG. 2. The scanning electrodes Y1 to Ym and the sustaining electrodes Z1 to Zm arranged in parallel cross the data electrodes X1 to Xn at each discharge cell.

Such a PDP drives one frame, which is divided into various sub-fields having a different discharge frequency, so as to realize gray levels of a picture. Each sub-field is again divided into a reset interval for uniformly causing a discharge, an address interval for selecting the discharge cell and a sustaining interval for realizing the gray levels depending on the discharge frequency.

For instance, when it is intended to display a picture of 256 gray levels, a frame interval equal to 1/60 second (i.e. 16.67 msec) is divided into 8 sub-fields SF1 to SF8 as shown in FIG. 3. Each of the 8 sub-fields SF1 to SF8 is again divided into a reset interval, an address interval and a sustaining interval. The reset interval and the address interval of each sub-field are equal every sub-field. The address discharge for selecting the cell is caused by a voltage difference between the data electrode X and the scanning electrode Y. The sustaining interval is increased at a ration of $2^n$ (wherein n=0, 1, 2, 3, 4, 5, 6 and 7) at each sub-field. A sustaining discharge frequency in the sustaining interval is controlled at each sub-field in this manner, to thereby realize a gray scale required for a picture display. The sustaining discharge is generated by a high voltage of pulse signal applied alternately to the scanning electrode Y and a sustaining electrode Z.

FIG. 4 illustrates driving waveforms of the three-electrode PDP.

Referring to FIG. 4, in the reset interval, a reset discharge for initializing the discharge cell is generated by a reset pulse Vr applied to the sustaining electrode Z. Such a reset pulse Vr may be applied to the scanning electrode Y. At this time, a positive pulse signal with a low voltage level is applied to the data electrode X so as to prevent an erroneous discharge from being generated between the sustaining electrode Z and the data electrode X.

In the address interval, a scanning pulse −Vsc is sequentially applied to the scanning electrode Y and a data pulse Vd synchronized with the scanning pulse −Vsc is applied to the data electrode X. An address discharge is generated at the discharge cell supplied with the data pulse Vd. A low-level positive direct current (DC) voltage is applied to the sustaining electrode Z so as to prevent an erroneous discharge from being generated between the data electrode X and the sustaining electrode Z.

In the sustaining interval, a sustaining pulse Vs are alternately applied to the scanning electrode Y and the sustaining electrode Z. Then, the discharge cells selected by the address discharge generates a sustaining discharge continuously whenever the sustaining pulse Vs is applied.

Since such a three-electrode PDP has the scanning electrode Y and the sustaining electrode Z positioned at the upper center of the discharge space, it has a low utility of the discharge space. For this reason, in the three-electrode PDP, a voltage for causing a sustaining discharge and a power consumption are high while discharge and light-emission efficiencies during the sustaining discharge are low. More specifically, the sustaining discharge takes a surface discharge between the scanning electrode Y and the sustaining electrode Z. However, since the scanning electrode Y and the sustaining electrode Z concentrate at the center of the cell to lower a discharge-initiating voltage, a discharge path becomes short to cause low discharge and light-emission efficiencies. When a distance between the scanning electrode Y and the sustaining electrode is enlarged so as to enhance the efficiencies, a discharge-initiating voltage becomes high in proportional to a distance between the two electrodes. Furthermore, when an electrode width of at least one of the scanning electrode Y and the sustaining electrode Z is widened so as to enhance an efficiency, power consumption rises due to an increase in discharge current.

In order to solve the problems of the three-electrode PDP, there has been suggested a five-electrode PDP in which an electrode for causing a sustaining discharge is divided into four electrodes.

Referring to FIG. 5, the conventional five-electrode PDP includes first and second trigger electrodes TY and TZ provided on an upper substrate 34 in such a manner to be positioned at the center of a discharge cell, first and second sustaining electrodes SY and SZ provided on the upper substrate 34 in such a manner to be positioned at the edge of the discharge cell, and a data electrode X provided at a lower substrate 40 in such a manner to be perpendicular to the trigger electrodes TY and TZ and the sustaining electrodes SY and SZ.

The trigger electrodes TY and TZ and the sustaining electrodes SY and SZ include transparent electrodes having a large width and metal bus electrodes having a small width, respectively, and are formed on the upper substrate 34 in parallel. The trigger electrodes TY and TZ can be easily discharged at a low potential difference because a distance Ni between the electrodes is small. The first trigger electrode TY also plays a role to cause an address discharge by a voltage level difference between an applied scanning pulse and a data pulse applied to the data electrode X. The sustaining electrodes SY and SZ are set to have a large distance Wi between the electrodes with having the trigger electrodes TY and YZ therebetween. The sustaining electrodes SY and SZ causes a long-path discharge by utilizing space charges and wall charges formed by a discharge between the trigger electrodes TY and TZ.

An upper dielectric layer 36 and a protective film 38 are disposed on the upper substrate 34 in such a manner to cover the trigger electrodes TY and TZ and the sustaining electrodes SY and SZ. Wall charges generated upon plasma discharge are accumulated in the upper dielectric layer 36. The protective film 38 prevents a damage of the upper dielectric layer 36 caused by a sputtering during the plasma discharge and improves the emission efficiency of secondary electrons. This protective film 38 is usually made from magnesium oxide (MgO).

A lower dielectric layer 44 and barrier ribs 46 are formed on the lower substrate 40. The surfaces of the lower dielectric layer 44 and the barrier ribs 46 are coated with a fluorescent material layer 48. The barrier ribs 46 separate adjacent discharge spaces in the horizontal direction to thereby prevent optical and electrical crosstalk between adjacent discharge cells. The fluorescent material layer 48 is excited by an ultraviolet ray generated during the plasma discharge to generate any one of red, green and blue visible light rays. An inactive mixture gas of He+Xe or Ne+Xe is injected into a discharge space defined among the upper and lower substrate 34 and 40 and the barrier ribs 46.

Discharge cells of the five-electrode PDP are arranged at a panel 60 in a matrix pattern as shown in FIG. 6. Pairs of the scanning electrodes TY1 to TYm and TZ1 to TZm and pairs of the sustaining electrodes SY1 to SYm and SZ1 to SZm arranged in parallel cross the data electrodes X1 to Xn at each discharge cell.

Like the three-electrode PDP, such a five-electrode AC surface-discharge PDP drives one frame, which is divided into various sub-fields having a different discharge frequency, so as to realize gray levels of a picture.

FIG. 7 shows driving waveforms of the five-electrode PDP.

Referring to FIG. 7, in the reset interval, a positive reset pulse Vrst having a high voltage level is applied to the second trigger electrode TZ. Then, the discharge cells at the entire field are reset-discharged to left a constant quantity of wall charges at the discharge cells a the entire field. At this time, a positive pulse signal with a low voltage level is applied to the data electrode X so as to prevent an erroneous discharge from being generated between the second trigger electrode TZ and the data electrode X.

In the address interval, a scanning pulse −Vsc is sequentially applied to the first trigger electrodes TY. A data pulse Vd synchronized with the scanning pulse −Vsc is simultaneously applied to the data electrodes X. The discharge cell supplied with the data pulse Va causes an address discharge by a voltage difference between the data electrode X and the first trigger electrode TY and an internal wall voltage.

In the sustaining interval, a trigger pulse Vt and a sustaining pulse Vs are simultaneously applied to the first trigger electrode TY and the first sustaining electrode SY, respectively. Also, the trigger pulse Vt and the sustaining pulse Vs are simultaneously applied to the second trigger electrode TZ and the second sustaining electrode SZ, respectively. Herein, a voltage level of the trigger pulse Vt is set to be lower than that of the sustaining pulse Vs. When a first trigger pulse Vt is applied to the first trigger electrode TY, the discharge cells having generated the address discharge cause a short-path discharge between the first trigger electrode TY and the second trigger electrode TZ. By this short-path discharge, space charges and wall charges are created within the discharge cells selected by the address discharge. The space charges and the wall charges created by the short-path discharge provide a priming effect with respect to a long-path discharge between the first and second sustaining electrodes SY and SZ. In other words, the priming effect caused by the short-path discharge induces a long-path discharge between the first and second electrodes SY and SZ. In other words, the short-path discharge between the trigger electrodes TY and TZ can cause a long-path discharge between the sustaining electrodes SY and SZ having a wide distance between electrodes at a low voltage.

The sustaining discharge process in the five-electrode PDP is as shown in FIG. 8A and FIG. 8B.

Referring to FIG. 8A and FIG. 8B, if a trigger pulse Vt is applied to the first trigger electrode TY, then a short-path discharge is generated between the first trigger electrode TY and the second trigger electrode TZ. Subsequently, when a sustaining pulse Vs synchronized with the trigger pulse Vt is applied to the first sustaining electrode SY, a discharge occurs between the first trigger electrode TY and the first sustaining electrode SY as shown in FIG. 8A with the aid of wall charges and space charges created upon discharge between the first trigger electrode TY and the second trigger electrode TZ. Likewise, when a sustaining pulse Vs synchronized with the trigger pulse Vt is applied to the second sustaining electrode SZ, a discharge occurs between the second trigger electrode TZ and the second sustaining electrode SZ as shown in FIG. 8B with the aid of wall charges and space charges created upon discharge between the first trigger electrode TY and the second trigger electrode TZ. When the wall charges and the space charges created by the discharge between the first trigger electrode TY and the first sustaining electrode SY (or the discharge between the second trigger electrode TZ and the second sustaining electrode SZ) is added to a sustaining pulse Vs applied from the exterior to generate a voltage difference enough to cause a long-path discharge, a long-path discharge occurs between the first sustaining electrode SY and the second sustaining electrode SZ.

Herein, the long-path discharge between the first and second sustaining electrodes SY and SZ only contributes to brightness. The discharge between the trigger electrodes TY and TZ or the short-path discharge between any one trigger electrode TY or TZ and any one sustaining electrode SY or SZ are priming discharges for creating charged particles permitting a long-path discharge.

In the conventional five-electrode PDP, the discharge between the trigger electrodes TY and TZ spaced at a narrow distance Ni or the short-path discharge between any one trigger electrode TY or TZ and any one sustaining electrode SY or SZ should be weakly generated for the purpose of obtaining a stable long-path discharge. Also, in the conventional five-electrode PDP, since most wall charges created by the address discharge concentrates on the first trigger electrode TY, the discharge between the trigger electrodes TY and TZ during the sustaining discharge is relatively strongly generated while the long-path discharge between the sustaining electrodes SY and SZ is weakly generated.

An experimental result shows that the discharge between any one trigger electrode TY or TZ and any one sustaining electrode SY or SZ weakens the long-path discharge between the sustaining electrodes SY and SZ to cause a deterioration of brightness. Accordingly, there has been required a scheme capable of weakening or eliminating the discharges between the trigger electrode TY or TZ and the sustaining electrodes SY and SZ causing a deterioration of brightness.

SUMMARY OF THE INVENTION

Accordingly, it is an object of the present invention to provide a method of driving a plasma display panel that is adaptive for improving brightness and efficiency.

In order to achieve these and other objects of the invention, a method of driving a plasma display panel according to an embodiment of the present invention includes the steps of alternately applying a sustaining pulse for sustaining a discharge of a cell selected in a sustaining interval to each of a sustaining electrode pair; and applying a pulse signal synchronized with the sustaining pulse to a data electrode to cause a discharge for inducing a long-path discharge between the sustaining electrode pair between any one of the sustaining electrode pair and the data electrode.

In the method, said pulse signal applied to the data electrode has twice the frequency of the sustaining pulse.

A pulse having a lower voltage than the sustaining pulse is alternately applied to each of the trigger electrode pair spaced at a short path smaller than said long path between the sustaining electrode pair.

A pulse applied to the data electrode has more than ⅓ times the voltage level of the sustaining pulse.

A method of driving a plasma display panel according to another embodiment of the present invention includes the steps of applying a first trigger pulse to at least one of a trigger electrode pair to cause a short-path trigger discharge; alternately applying a sustaining pulse to a sustaining electrode pair having a larger distance between electrodes than the trigger electrode pair to cause a long-path sustaining discharge; and applying a second trigger pulse overlapping with the sustaining pulse to at least one of the trigger electrode pair to shut off a discharge between the trigger electrode and the sustaining electrode.

In the method, the second trigger pulse has a pulse width larger than the first trigger pulse.

The second trigger pulse overlaps with the first trigger pulse.

The second trigger pulse is applied to each of the trigger electrode pair at a desired phase difference after an application of the first trigger pulse.

The first and second trigger pulses have a lower voltage than the sustaining pulse.

A method of driving a plasma display panel according to still another aspect of the invention includes the steps of supplying a data for selecting a cell to a data electrode; applying a scanning pulse synchronized with said data to at least two electrodes to cause an address discharge; and sustaining a discharge of the selected cell using wall charges formed on the electrodes by said address discharge.

In the method, said step of causing the address discharge includes simultaneously applying a scanning pulse to any one trigger electrode of a trigger electrode pair and any one sustaining electrode of a sustaining electrode pair has a larger distance between electrodes than the trigger electrode pair.

Said step of sustaining a discharge of said cell includes simultaneously applying a sustaining pulse to any one trigger electrode of the trigger electrode pair and any one sustaining electrode of the sustaining electrode pair; and simultaneously applying a sustaining pulse to other trigger electrode of the trigger electrode pair and other sustaining electrode of the sustaining electrode pair.

In the method, said sustaining pulse applied to the trigger electrode has a voltage level different from said sustaining pulse applied to the sustaining electrode.

Said step of causing the address discharge includes simultaneously applying a scanning pulse to each of the sustaining electrode pair.

Said step of sustaining a discharge of said cell includes simultaneously applying a sustaining pulse to each of the trigger electrode pair; and applying a sustaining pulse to each of a trigger electrode pair having a smaller distance between electrodes than said trigger electrode pair.

In the method, said sustaining pulse applied to the trigger electrode has a voltage level different from said sustaining pulse applied to the sustaining electrode.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 1:
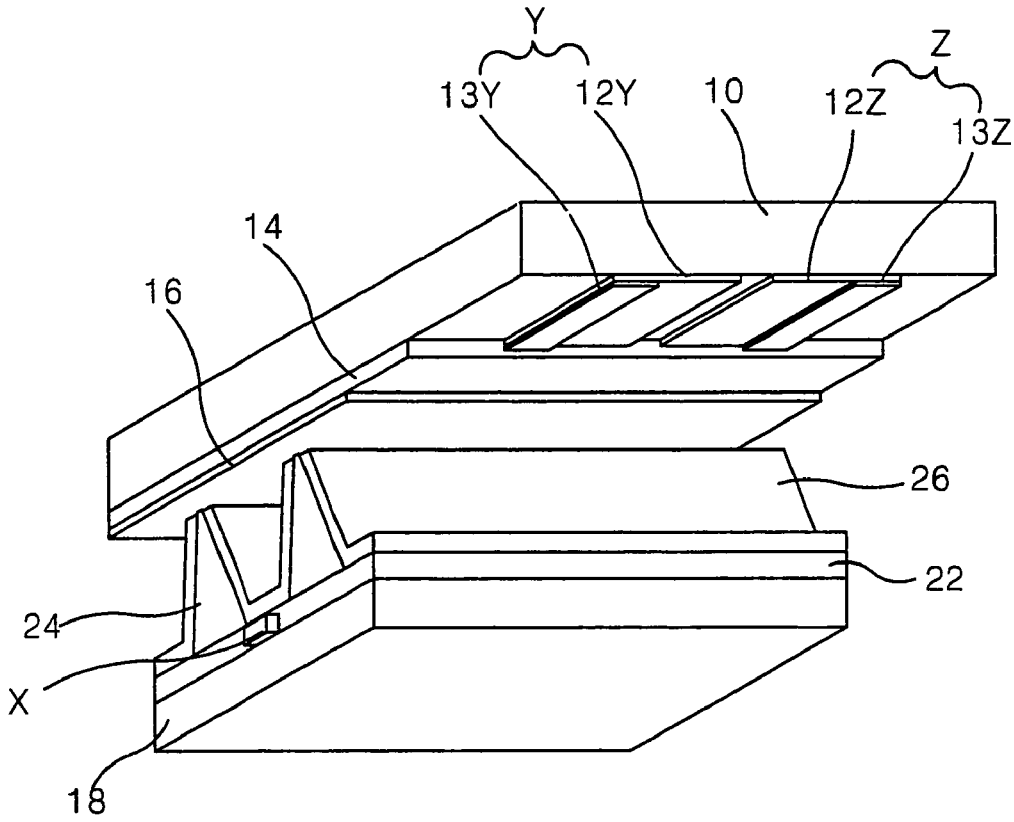
FIG. 1 CONVENTIONAL ART
FIG. 1 is a perspective view showing a structure of a discharge cell of a conventional three-electrode plasma display panel.
Figure 2:
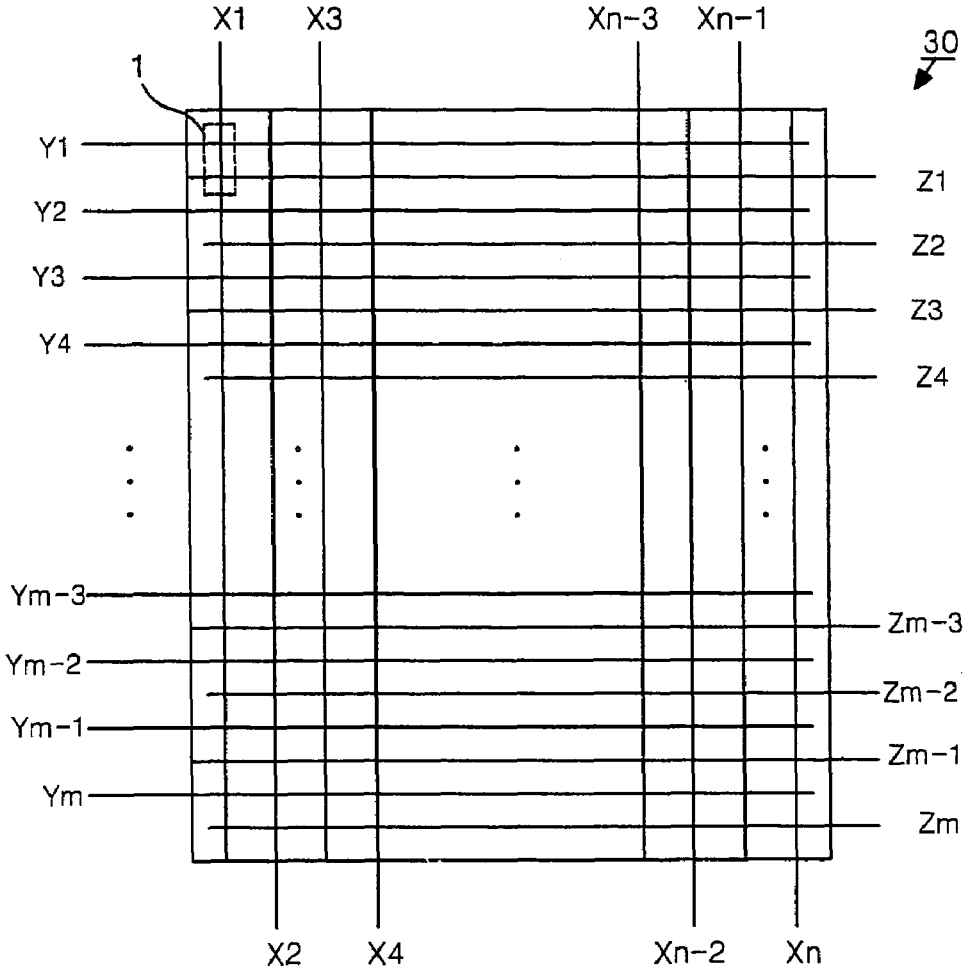
FIG. 2 CONVENTIONAL ART
FIG. 2 is a plan view showing an electrode arrangement of the three-electrode plasma display panel in FIG. 1.
Figure 3:
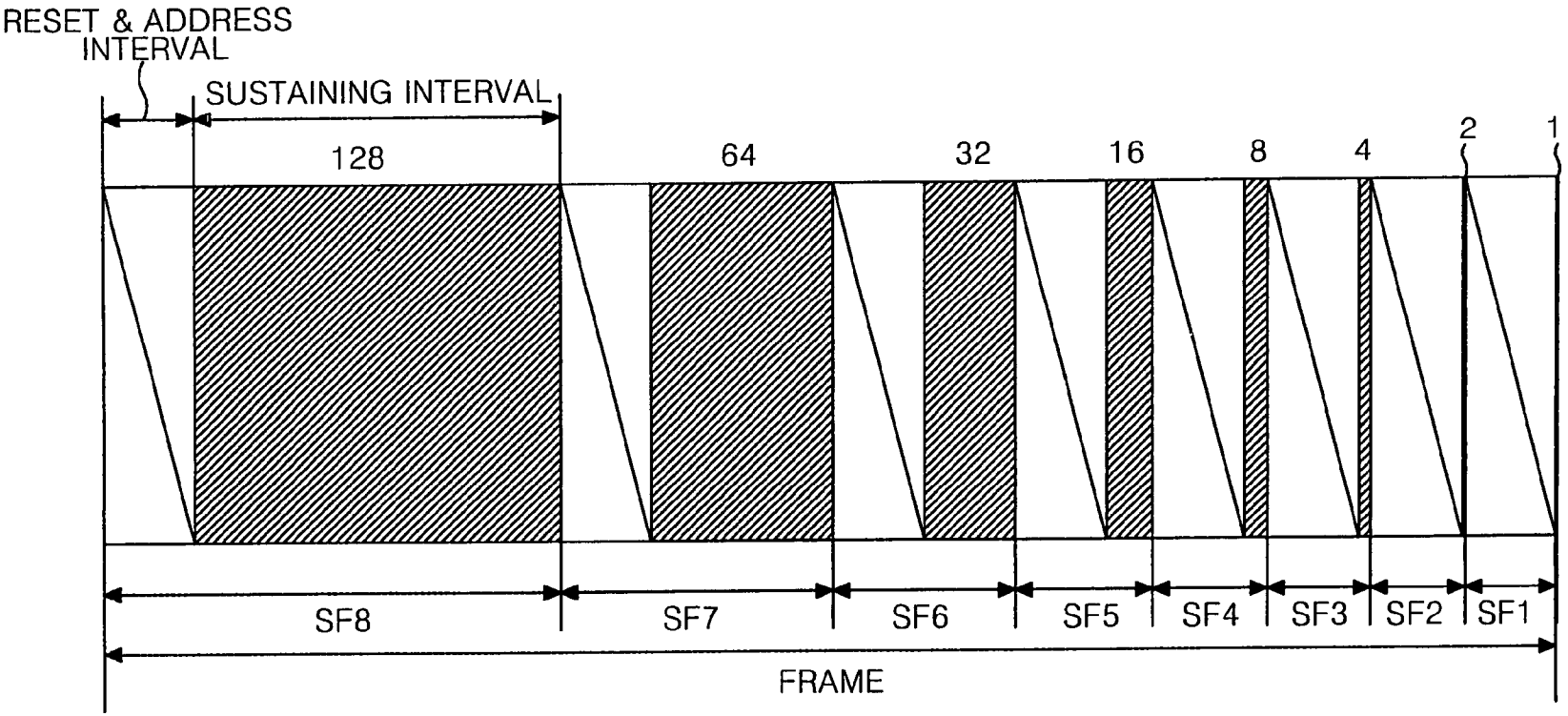
FIG.3 CONVENTIONAL ART
FIG. 3 depicts a configuration of one frame in the PDP.
Figure 4:
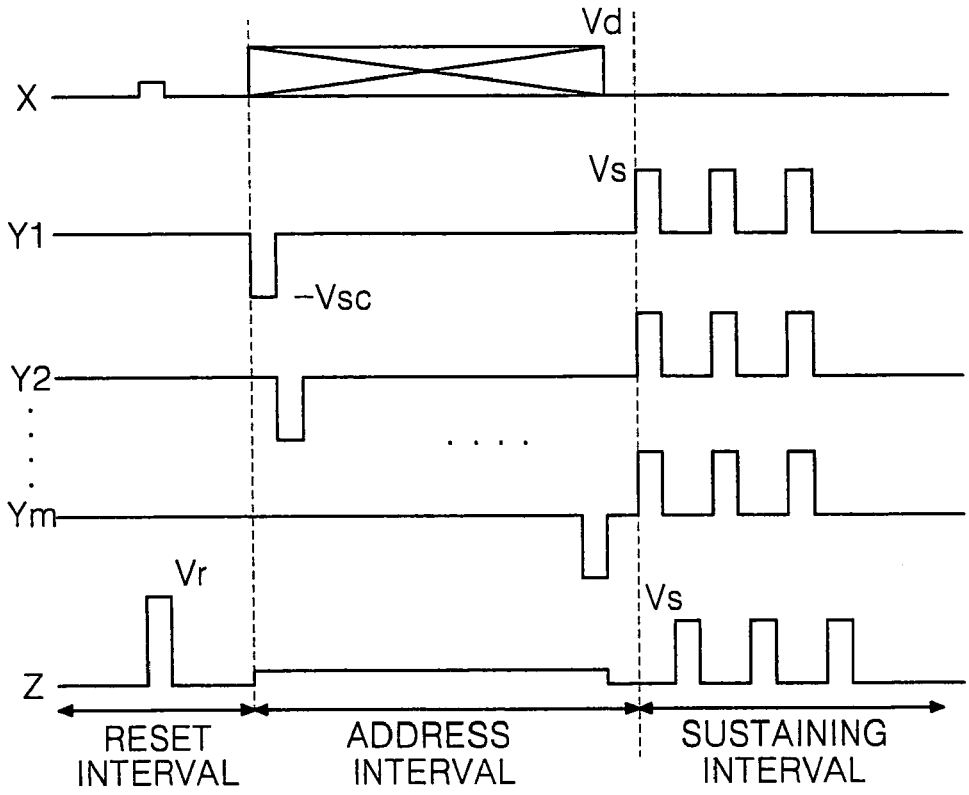
FIG. 4 CONVENTIONAL ART
FIG. 4 is a waveform diagram of driving signals for the three-electrode plasma display panel shown in FIG. 1.
Figure 5:
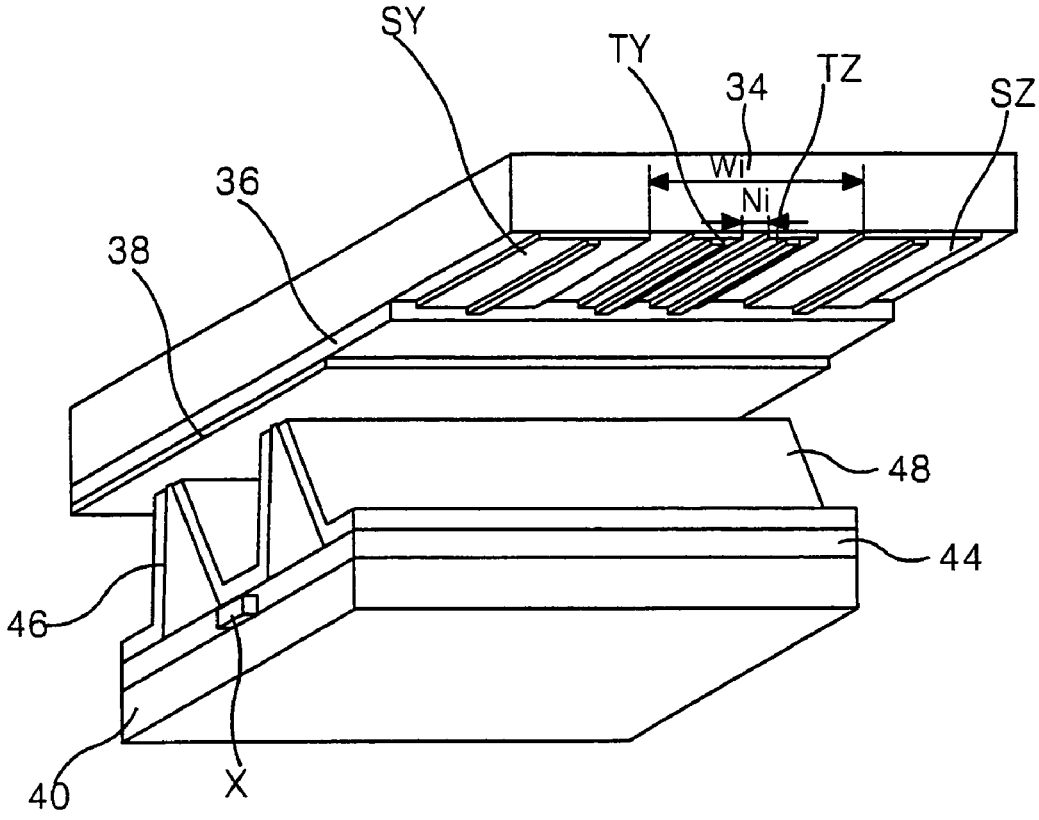
FIG.5 CONVENTIONAL ART
FIG. 5 is a perspective view showing a structure of a discharge cell of a conventional five-electrode plasma display panel.
Figure 6:
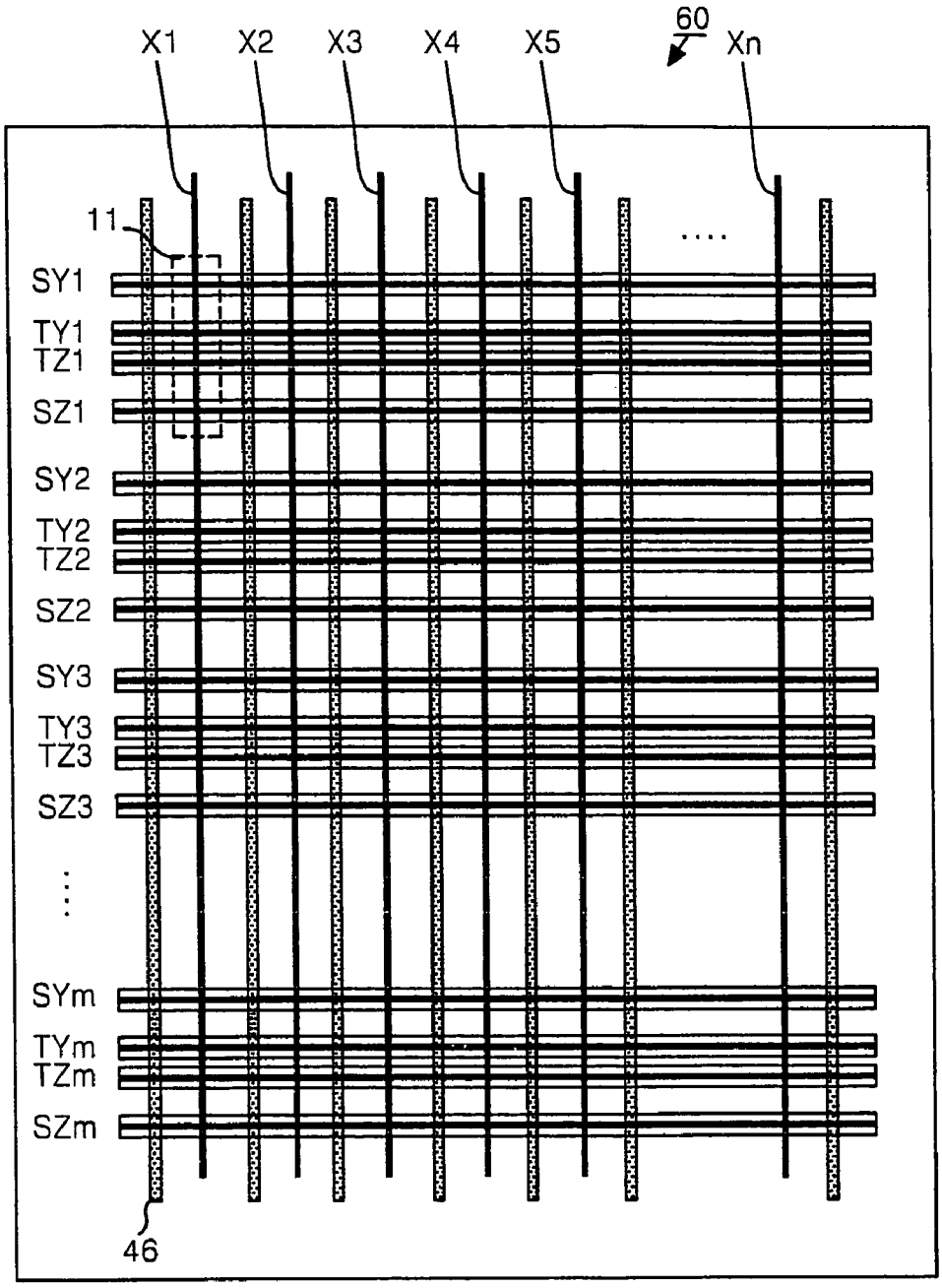
FIG.6 CONVENTIONAL ART
FIG. 6 is a plan view showing an electrode arrangement of the five-electrode plasma display panel in FIG. 5.
Figure 7:
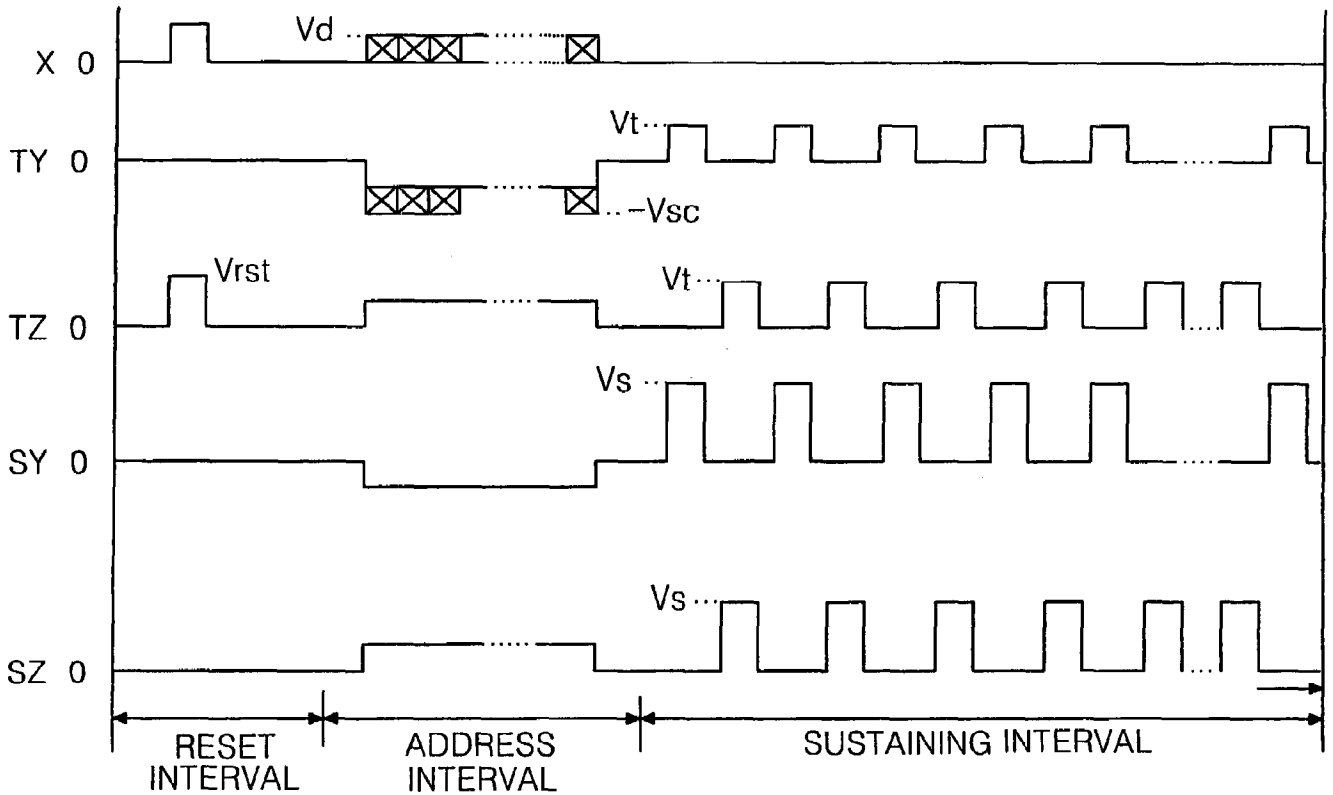
FIG. 7 CONVENTIONAL ART
FIG. 7 is a waveform diagram of driving signals for the five-electrode plasma display panel shown in FIG. 5.
Figure 8A:
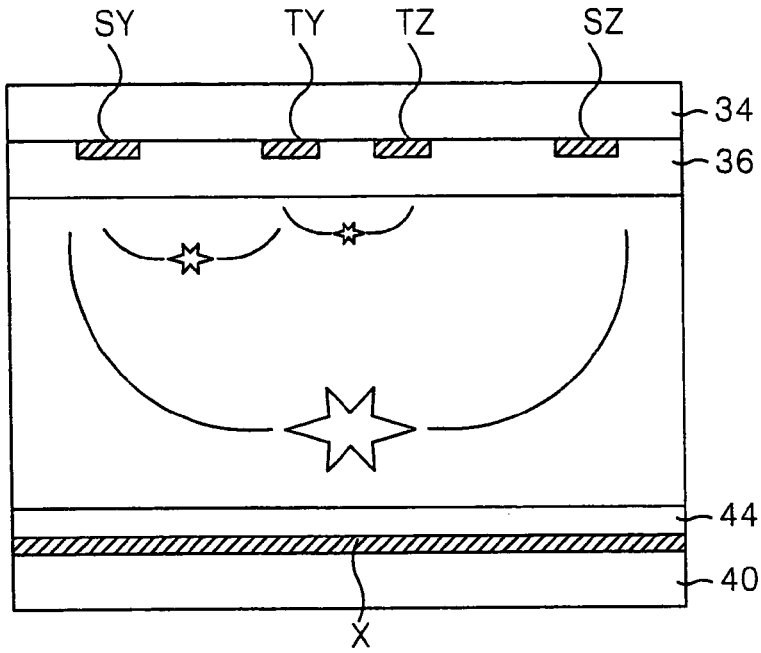
FIG. 8A CONVENTIONAL ART
FIG. 8A and FIG. 8B are section views showing a sustaining discharge process in the five-electrode plasma display panel.
Figure 8B:
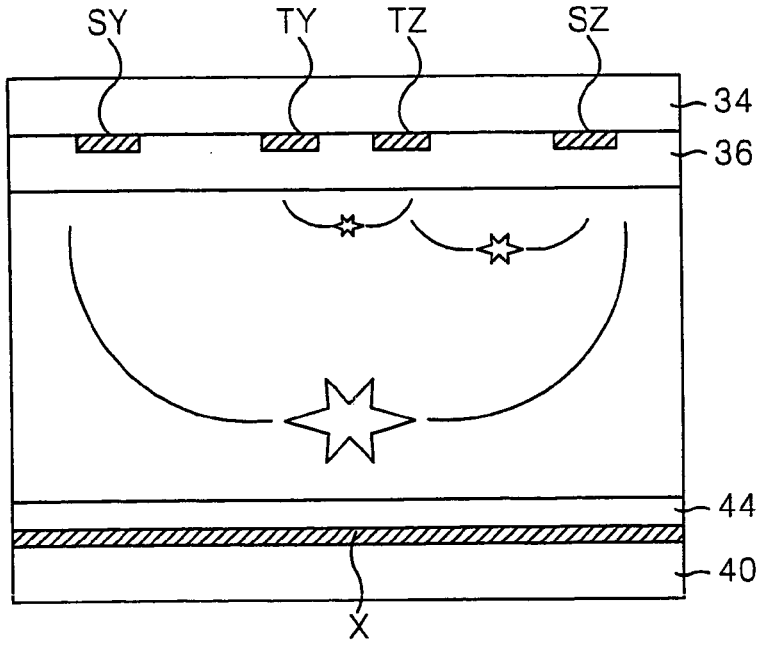
FIG. 8B CONVENTIONAL ART
Figure 9:
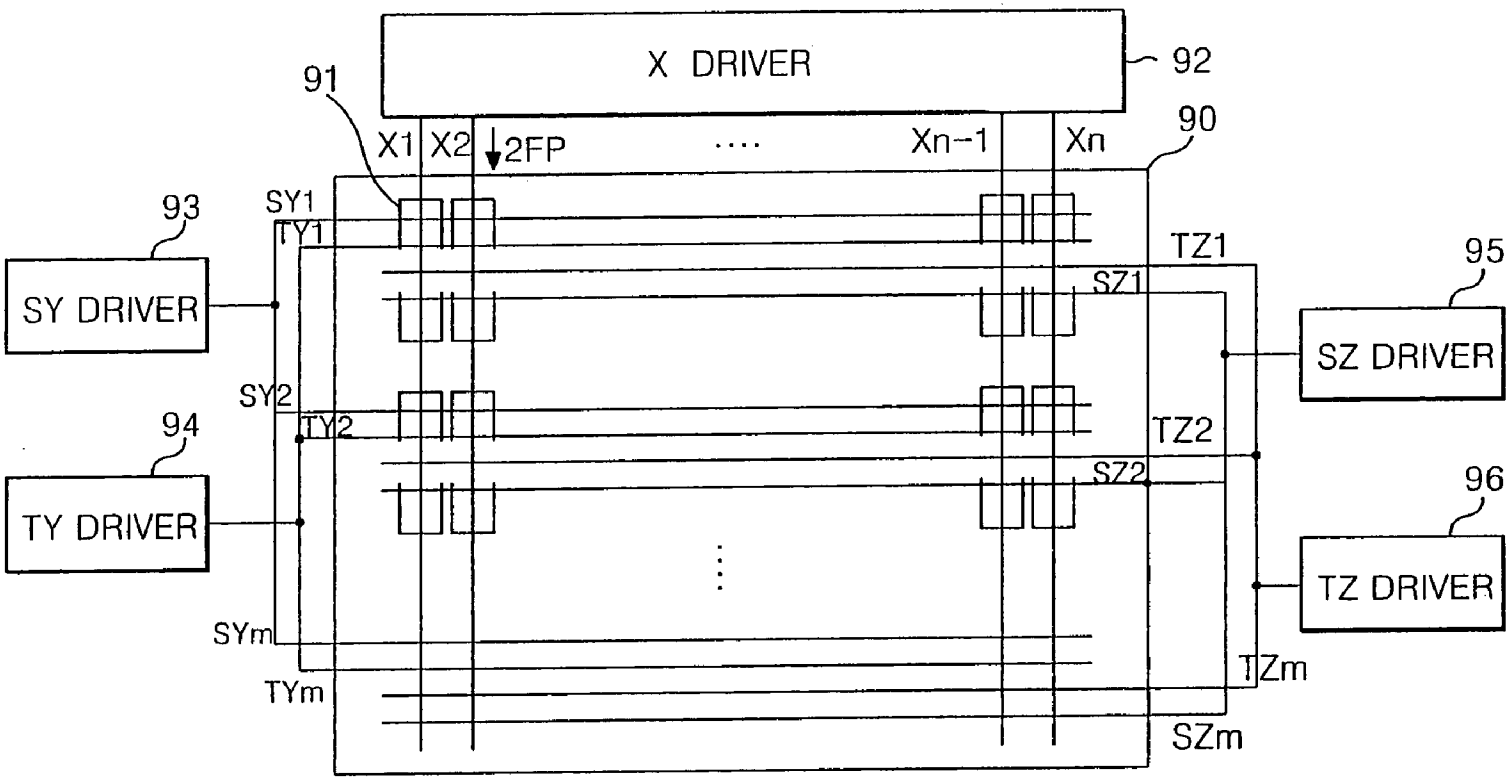
FIG. 9 is a block diagram showing a configuration of a driving apparatus for a plasma display panel according to a first embodiment of the present invention.

Referring to FIG. 9, there is shown a driving apparatus for a plasma display panel (PDP) according to a first embodiment of the present invention.

The driving apparatus includes a PDP 90 having discharge cells 91 arranged in a matrix type and having data electrodes X1 to Xn being perpendicular to trigger electrode pairs TY1 to TYm and TZ1 to TZm and sustaining electrode pairs SY1 to SYm and SZ1 to SZm at the discharge cells, a X driver 92 for applying a twice trigger pulse 2FP having twice the frequency of a sustaining pulse to the data electrodes X1 to Xn after a video data was supplied to the data electrodes X1 to Xn of the PDP 90, TY and TZ drivers 94 and 96 for driving the trigger electrodes TY1 to TYm and TZ1 to TZm, and SY and SZ drivers 93 and 95 for driving the sustaining electrodes SY1 to SYm and SZ1 to SZm.

In the PDP 90, the trigger electrode pairs TY1 to TYm and TZ1 to TZm and the sustaining electrode pairs SY1 to SYm and SZ1 to SZm are provided at an upper substrate (not shown). A distance between each trigger electrode pair TY1 to TYm and TZ1 to TZm is set to be smaller than a distance between each sustaining electrode pair SY1 to SYm and SZ1 to SZm.

The X driver 92 applies a data pulse to the data electrodes X1 to Xn in the address interval to select a discharge cell. Then, the X driver 92 applies a twice trigger pulse 2FP having twice the frequency of a sustaining pulse supplied to the trigger electrodes TY1 to TYm and TZ1 to TZm and the sustaining electrodes SY1 to SYm and SZ1 to SZm in the sustaining interval to the data electrodes X1 to Xn. If the twice trigger pulse 2FP is applied, then an opposite discharge occurs between the data electrodes X1 to Xn and any one trigger electrodes TY1 to TYm or TZ1 to TZm. A long-path discharge is generated between the sustaining electrode pairs TY1 to TYm and TZ1 to TZm with the aid of wall charges and space charges created by said opposite discharge.

The SY driver 93 applies a negative DC voltage to the first sustaining electrodes SY1 to SYm in the address interval. Also, the SY driver 93 causes a long-path discharge between the sustaining electrode pairs SY1 to SYm and SZ1 to SZm with respect to a discharge cell selected by applying a sustaining pulse in the sustaining interval.

The SZ driver 95 applies a positive DC voltage to the second sustaining electrodes SZ1 to SZm in the address interval. Also, the SZ driver 95 applies a sustaining pulse to the second sustaining electrodes SZ1 to SZm in the sustaining interval to thereby cause a long-path discharge between the sustaining electrode pairs SY1 to SYm and SZ1 to SZm.

The TY driver 94 sequentially applies a scanning pulse for selecting a scanning line to the first trigger electrodes TY1 to TYm in the address interval. Also, the TY driver 94 applies a trigger pulse lower than the sustaining pulse to the first trigger electrodes TY1 to TYm in the sustaining interval.

The TZ driver 96 applies a reset pulse for initializing the entire field to the second trigger electrodes TZ1 to TZm in the reset interval and thereafter applies a positive DC voltage to the second trigger electrode TZ1 to TZm in the address interval. Also, the TZ driver 96 applies a trigger pulse lower than the sustaining pulse to the second trigger electrodes TZ1 to TZm in the sustaining interval.

Figure 10:
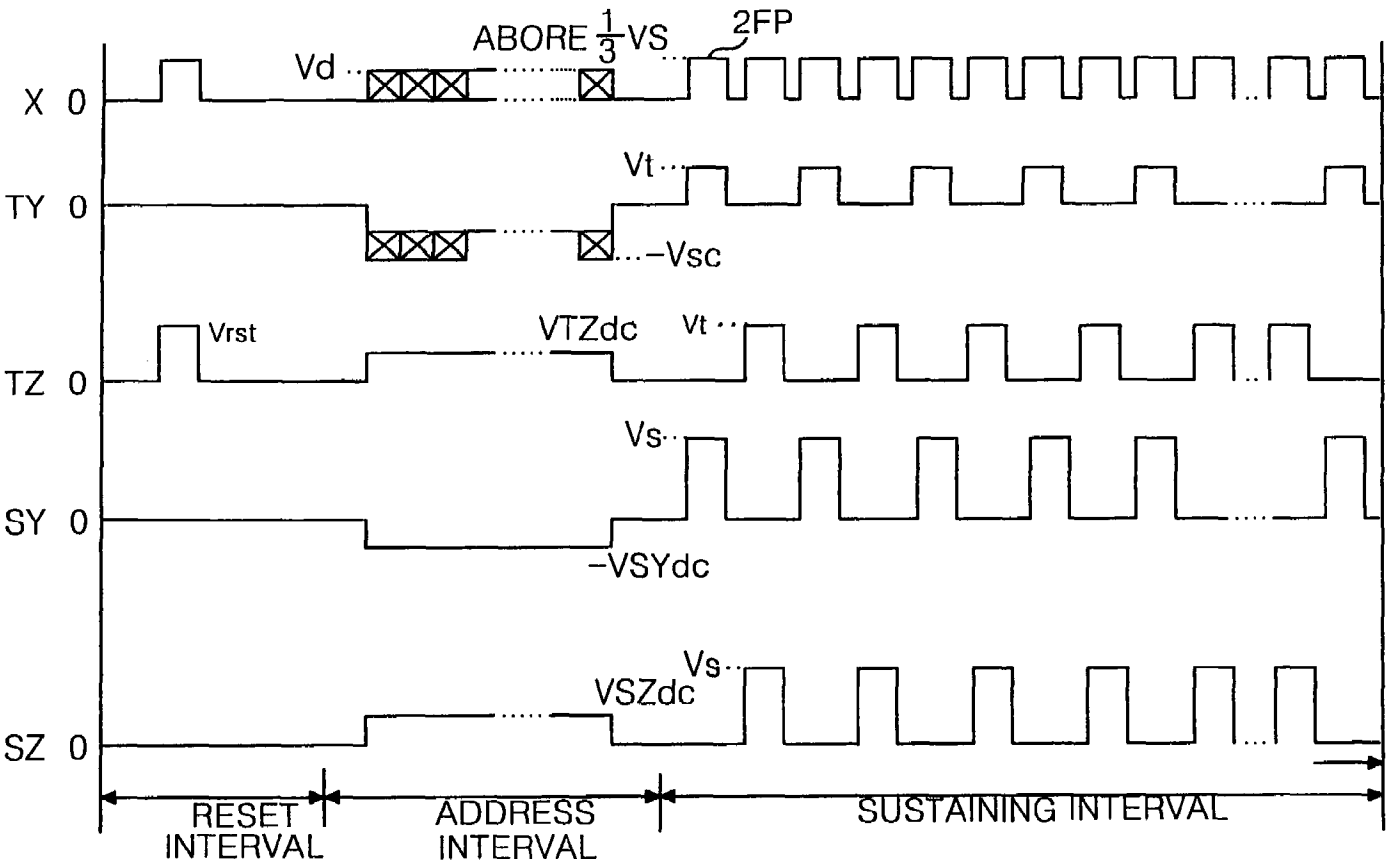
FIG. 10 is a waveform diagram of driving signals for the plasma display panel according to the first embodiment of the present invention.

FIG. 10 shows driving waveforms outputted from the drivers shown in FIG. 9.

Referring to FIG. 10, in the reset interval, a positive reset pulse Vrst having a high voltage level is applied to the second trigger electrode TZ. Then, the discharge cells at the entire field are reset-discharged to left a constant quantity of wall charges at the discharge cells at the entire field. At this time, a positive pulse signal with a low voltage level is applied to the data electrode X so as to prevent an erroneous discharge from being generated between the second trigger electrode TZ and the data electrode X.

In the address interval, a scanning pulse −Vsc is sequentially applied to the first trigger electrodes TY. A data pulse Vd synchronized with the scanning pulse −Vsc is simultaneously applied to the data electrodes X. The discharge cell supplied with the data pulse Va causes an address discharge by a voltage difference between the data electrode X and the first trigger electrode TY and an internal wall voltage. At this time, positive DC voltages VTZdc and VSZdc are applied to the second trigger electrode TZ and the second sustaining electrode SZ, respectively while a negative DC voltage −VSYdc is applied to the first sustaining electrode SY.

In the sustaining interval, a twice trigger pulse 2FP is applied to the data electrode X. Herein a voltage level of the twice trigger pulse 2FP is set to be in a range extended from more than ⅓ times of a sustaining voltage Vs until less than the sustaining voltage Vs. Trigger pulses Vt synchronized with the odd-numbered pulse and the even-numbered pulse of the twice trigger pulse 2FP are applied to the trigger electrode pair TY and TZ, respectively. Also, sustaining pulses synchronized with the odd-numbered pulse and the even-numbered pulse of the twice trigger pulse 2FP are applied to the sustaining electrode pair SY and SZ.

In the sustaining interval, after a vertical discharge was generated between any one of sustaining electrodes SY or SZ and the data electrode X every pulse of the twice trigger pulse 2FP applied to the data electrode X, a long-path discharge occurs between the sustaining electrode pair SY and SZ.

Figure 11A:
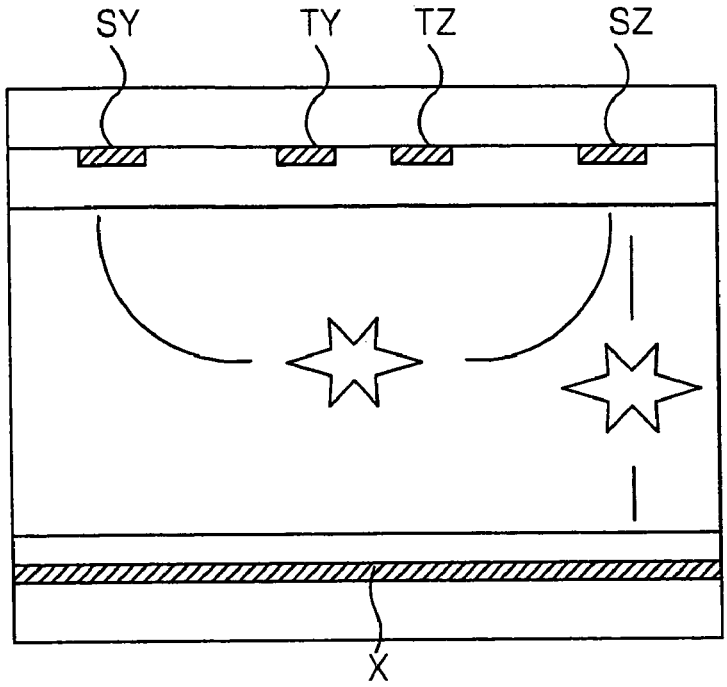
FIG. 11A and FIG. 11B are section view showing a sustaining discharge process in the plasma display panel according to the first embodiment of the present invention.

With reference to the sustaining discharge process, when a positive odd-numbered twice trigger pulse 2FP is applied to the data electrode X, positive voltages Vt and Vs are applied to the first trigger electrode TY and the first sustaining electrode SY, respectively, so that a discharge is not generated between these electrodes TY and SY and the data electrode X. On the other hand, a weak discharge is generated or a discharge is almost not generated between the data electrode X and the second trigger electrode TZ while a discharge as shown in FIG. 11A is generated between the data electrode X and the second sustaining electrode SZ. Wall charges and space charges are created from a discharge occurring vertically between the data electrode X and the second sustaining electrode SZ. These charged particles cause a long-path discharge between the sustaining electrode pair SY and SZ.

Figure 11B:
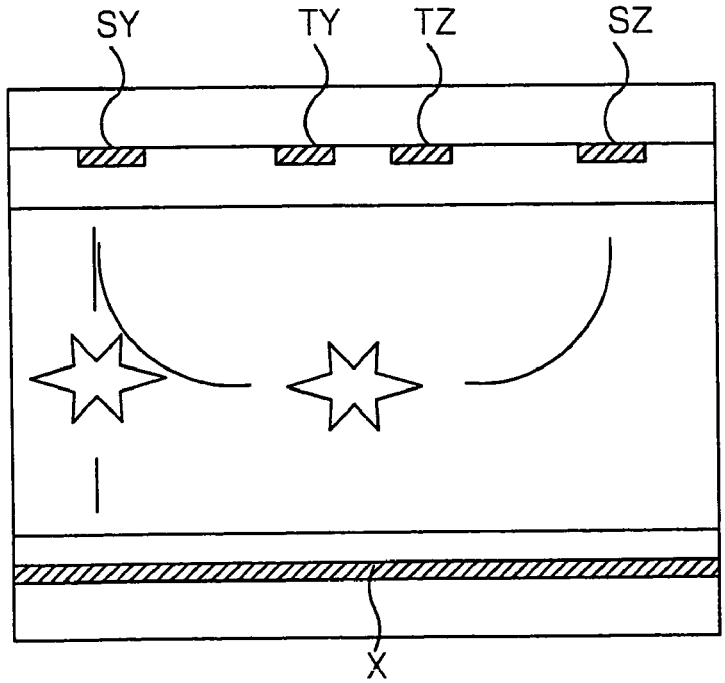

Likewise, when a positive even-numbered twice trigger pulse 2FP is applied to the data electrode X, positive voltages Vt and Vs are applied to the second trigger electrode TZ and the second sustaining electrode SZ, respectively, so that a discharge is not generated between these electrodes TZ and SZ and the data electrode X. On the other hand, a weak discharge is generated or a discharge is almost not generated between the data electrode X and the first trigger electrode TY while a discharge as shown in FIG. 11B is generated between the data electrode X and the first sustaining electrode SY. Wall charges and space charges are created from a discharge occurring vertically between the data electrode X and the first sustaining electrode SY. These charged particles cause a long-path discharge between the sustaining electrode pair SY and SZ.

Figure 12:
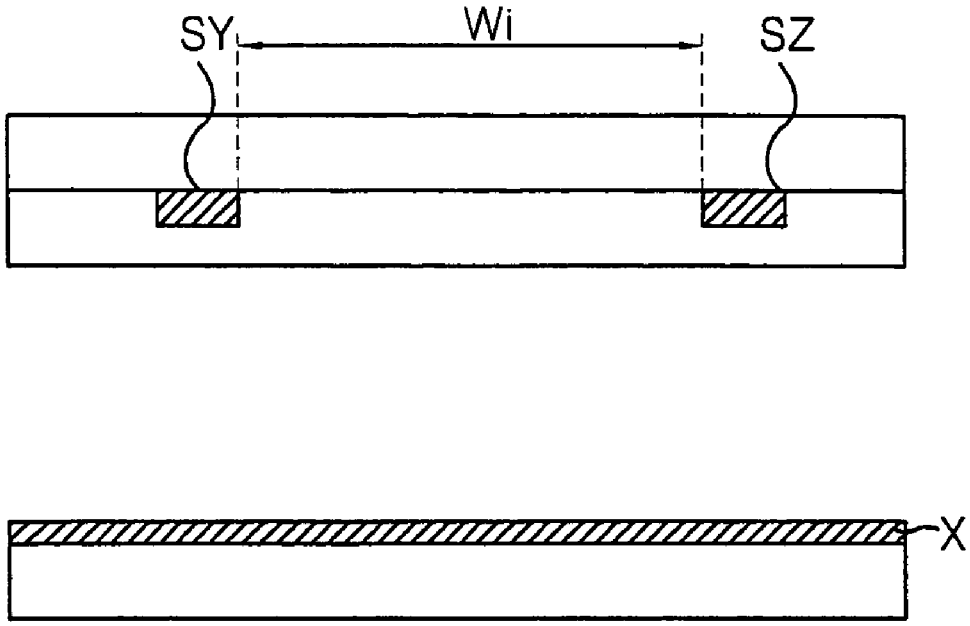
FIG. 12 is a section view of the plasma display panel according to the first embodiment of the present invention in which the trigger electrode pairs are removed.

Accordingly, a discharge between the trigger electrode pair TY and TZ or a discharge between the trigger electrode TY or TZ and the sustaining electrode SY or SZ is almost not generated, so that an efficiency of the long-path discharge occurring in the sustaining interval as well as a brightness can be improved. As a result, a long-path discharge can be generated even upon removal of the trigger electrode pair TY and TZ, to thereby implement a three-electrode PDP spaced at a distance Wi between the sustaining electrode pair of the five-electrode PDP as shown in FIG. 12.

Figure 13:
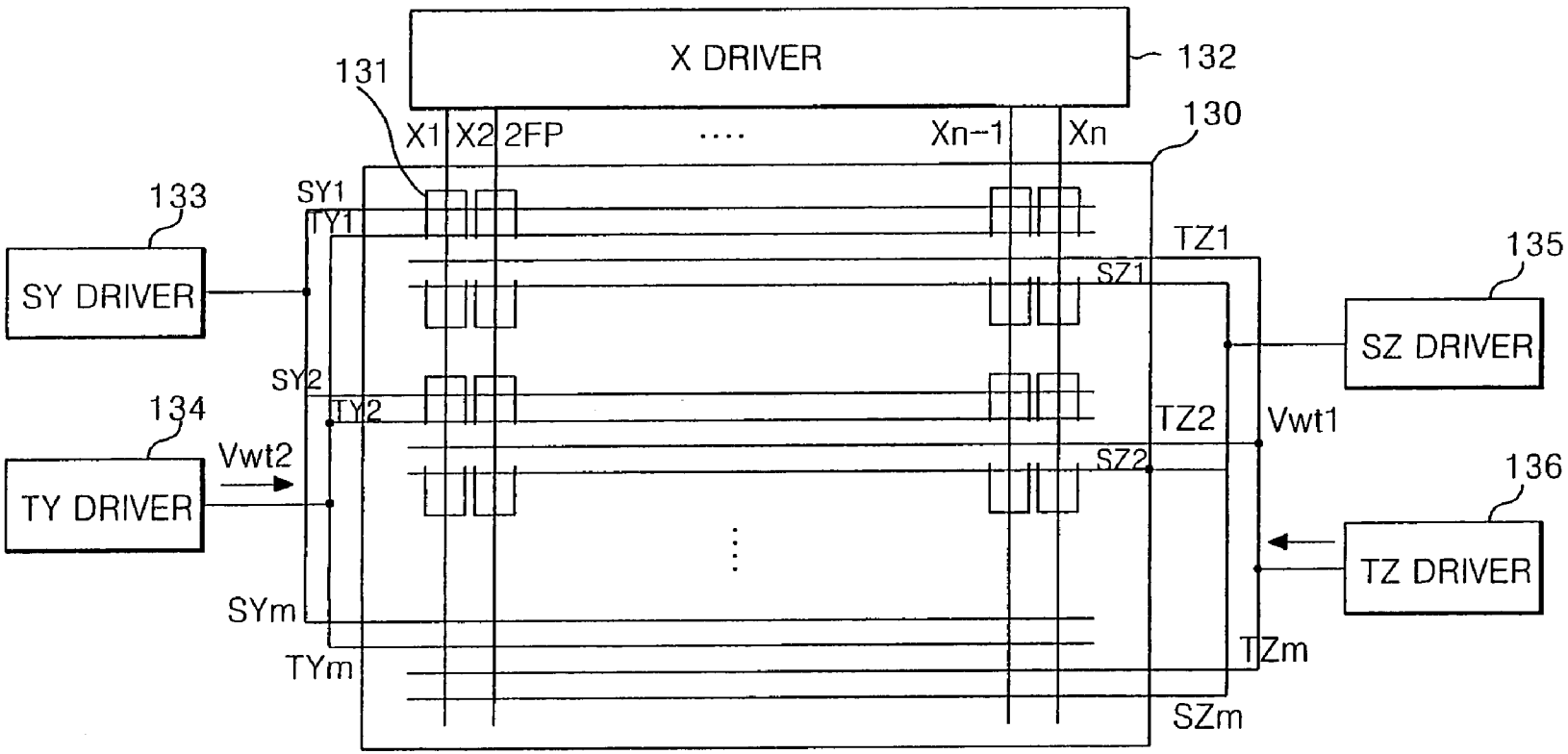
FIG. 13 is a block diagram showing a configuration of a driving apparatus for a plasma display panel according to a second embodiment of the present invention.

Referring to FIG. 13, a driving apparatus for a plasma display panel (PDP) according to a second embodiment of the present invention includes a PDP 130 having discharge cells 131 arranged in a matrix type and having data electrodes X1 to Xn being perpendicular to trigger electrode pairs TY1 to TYm and TZ1 to TZm and sustaining electrode pairs SY1 to SYm and SZ1 to SZm at the discharge cells, a X driver 132 for applying a video data to the data electrodes X1 to Xn of the PDP 130, a TY driver 134 for applying a scanning pulse to the first trigger electrodes TY1 to TYm and for applying a small width of trigger pulse and a large width of trigger pulse to the first trigger electrodes TY1 to TYm sequentially, a TZ driver 136 for applying a large width of trigger pulse to the second trigger electrodes TZ1 to TZm, and SY and SZ drivers 133 and 135 for driving the sustaining electrode pairs SY1 to SYm and SZ1 to SZm.

The PDP 130 has a configuration being substantially identical to the PDP 90 shown in FIG. 9.

The X driver 132 applies a data pulse to the data electrodes X1 to Xn in the address interval to select a discharge cell. Then, the X driver 132 applies a positive DC voltage to the data electrodes X1 to Xn in the sustaining interval.

The SY driver 133 applies a negative DC voltage to the first sustaining electrodes SY1 to SYm in the address interval. Also, the SY driver 133 causes a long-path discharge between the sustaining electrode pairs SY1 to SYm and SZ1 to SZm with respect to a discharge cell selected by applying a sustaining pulse in the sustaining interval.

The SZ driver 135 applies a positive DC voltage to the second sustaining electrodes SZ1 to SZm in the address interval. Also, the SZ driver 135 applies a sustaining pulse to the second sustaining electrodes SZ1 to SZm in the sustaining interval to thereby cause a long-path discharge between the sustaining electrode pairs SY1 to SYm and SZ1 to SZm.

The TY driver 134 applies a reset pulse for initializing the entire field in the reset interval and thereafter sequentially applies a scanning pulse for selecting a scanning line to the first trigger electrodes TY1 to TYm in the address interval. Also, the TY driver 134 applies a small width of trigger pulse to the first trigger electrode TY1 to TYm in the sustaining interval and thereafter applies a large width of trigger pulse Vwt2 to the first trigger electrode TY1 to TYm.

The TZ driver 136 applies a positive DC voltage to the second trigger electrodes TZ1 to TZm in the address interval. Also, the TZ driver 136 applies a large width of trigger pulse Vwt1 to the second trigger electrodes TZ1 to TZm in the sustaining interval. Herein, a trigger pulse generated from the TZ driver 136 is set to have a lower voltage level than the sustaining pulse. This trigger pulse is responsible for shutting off a discharge between the first trigger electrode TY1 to TYm and the sustaining electrode SY or SZ that weakens the long-path discharge between the sustaining electrode pair SY and SZ.

Figure 14:
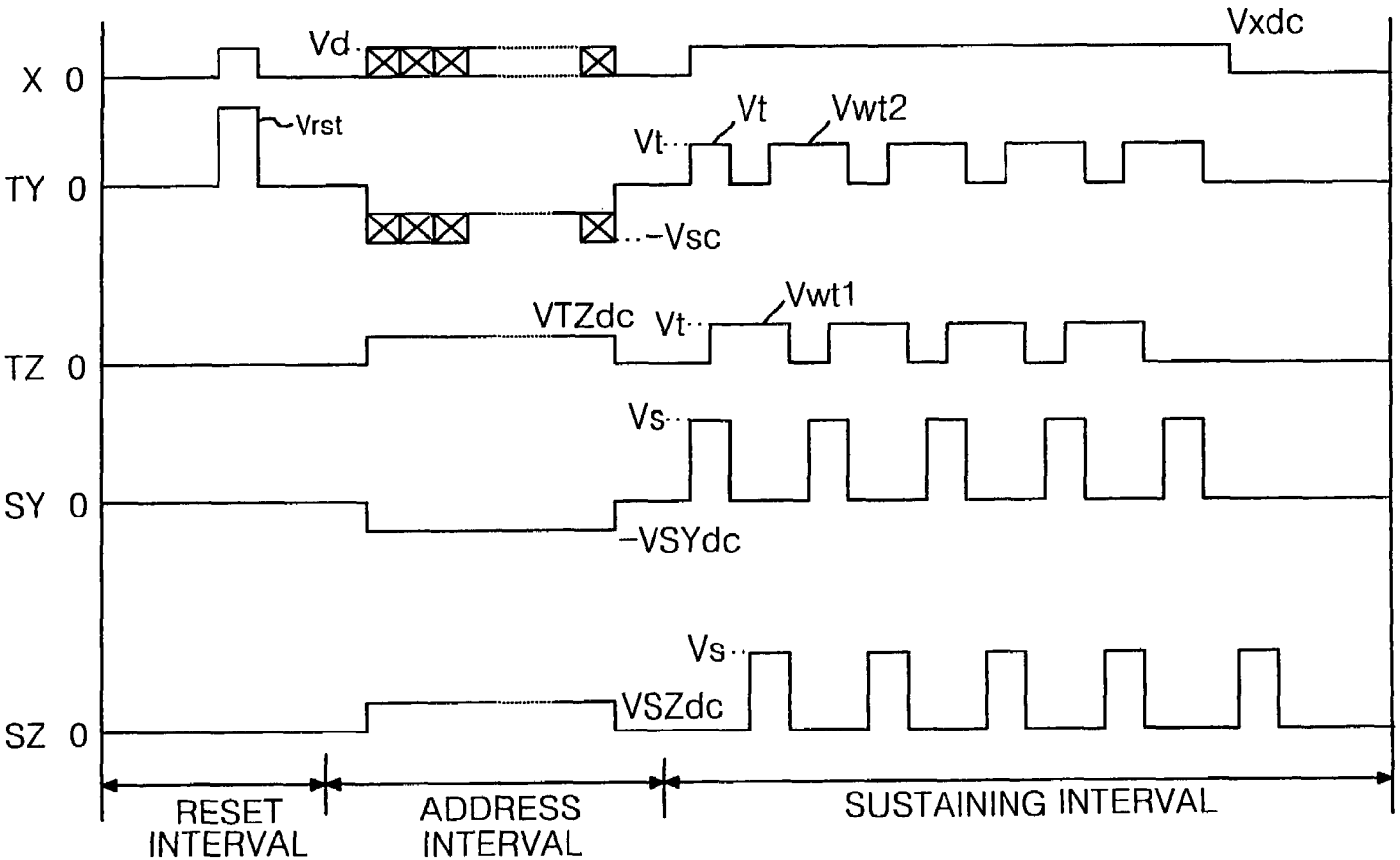
FIG. 14 is a waveform diagram of driving signals for the plasma display panel according to the second embodiment of the present invention.

FIG. 14 shows driving waveforms outputted from the drivers shown in FIG. 13.

Referring to FIG. 14, in the reset interval, a positive reset pulse Vrst having a high voltage level is applied to the first trigger electrode TY. Then, the discharge cells at the entire field are reset-discharged to left a constant quantity of wall charges at the discharge cells at the entire field. At this time, a positive pulse signal with a low voltage level is applied to the data electrode X so as to prevent an erroneous discharge from being generated between the first trigger electrode TY and the data electrode X.

In the address interval, a scanning pulse −Vsc is sequentially applied to the first trigger electrodes TY. A data pulse Vd synchronized with the scanning pulse −Vsc is simultaneously applied to the data electrodes X. The discharge cell supplied with the data pulse Va causes an address discharge by a voltage difference between the data electrode X and the first trigger electrode TY and an internal wall voltage. At this time, positive DC voltages VTZdc and VSZdc are applied to the second trigger electrode TZ and the second sustaining electrode SZ, respectively while a negative DC voltage −VSYdc is applied to the first sustaining electrode SY.

In the sustaining interval, a small width of trigger pulse Vt and a sustaining pulse Vs are simultaneously applied to the first trigger electrode TY and the first sustaining electrode SY, respectively. The trigger pulse Vt is set to have a pulse width being substantially identical to the conventional trigger pulse. At this time, a trigger discharge is generated between the trigger electrode pair TY and TZ. Subsequently, a large width of trigger pulse Vwt1 is applied to the second trigger electrode TZ in a time interval when the trigger pulse Vt and the sustaining pulse Vs applied to the first trigger electrode TY and the first sustaining electrode SY, respectively remains at a high logic. The large width of trigger pulse Vwt1 reduces a voltage difference between the second trigger electrode TZ and the first sustaining electrode SY into less than a voltage capable of causing a discharge, thereby shutting off a discharge between the second trigger electrode TZ and the first sustaining electrode SY. After a single of trigger pulse Vt with a small width was applied to the first trigger electrode TY, a plurality of trigger pulses LVwt2 with a large width is applied to the first trigger electrode TY. The large width of trigger pulse Vwt2 applied to the first trigger electrode TY shuts off a discharge between the first trigger electrode TY and the second sustaining electrode SZ.

In order to reduce a voltage between the trigger electrode TY or TZ and the sustaining electrode SY or SZ, the trigger pulses Vwt1 and Vwt2 are set to have a larger pulse width than the conventional trigger pulse such that they overlap with a trigger pulse other than themselves and a sustaining pulse. Also, the trigger pulses Vwt1 and Vwt2 have a period equal to the conventional trigger pulse and a duty ratio larger than the conventional trigger pulse.

In the second embodiment of the present invention, after a short-path discharge was generated between the trigger electrode pair TY and TZ during the sustaining discharge, charged particles created by that discharge causes a long-path discharge between the sustaining electrode pair SY and SZ.

Figure 15:
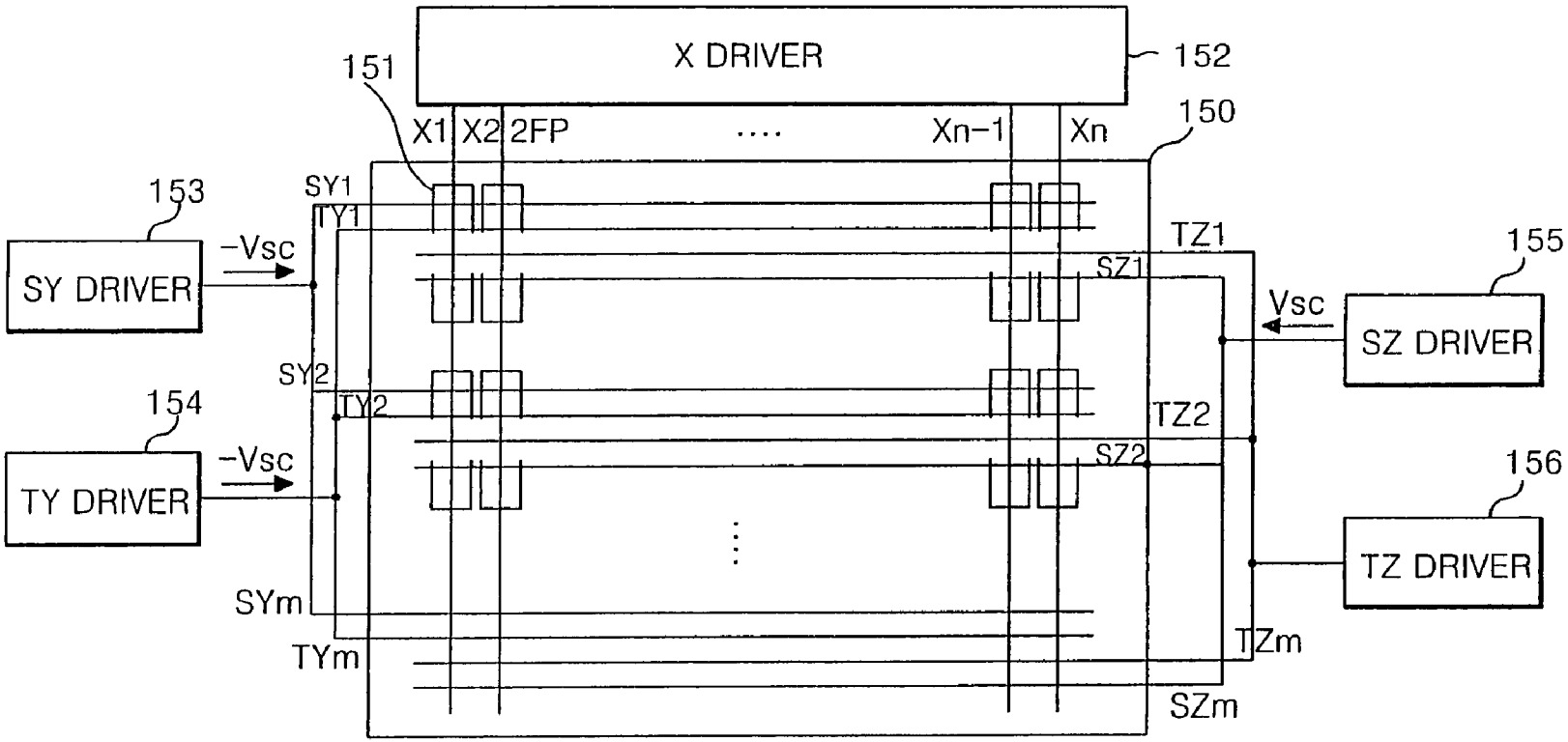
FIG. 15 is a block diagram showing a configuration of a driving apparatus for a plasma display panel according to a third embodiment of the present invention.

Referring to FIG. 15, a driving apparatus for a plasma display panel (PDP) according to a third embodiment of the present invention includes a PDP 150 having discharge cells 151 arranged in a matrix type and having data electrodes X1 to Xn being perpendicular to trigger electrode pairs TY1 to TYm and TZ1 to TZm and sustaining electrode pairs SY1 to SYm and SZ1 to SZm at the discharge cells 151, a X driver 152 for applying a video data to the data electrodes X1 to Xn of the PDP 150, SY and SZ drivers 153 and 155 for applying a scanning pulse to the first sustaining electrodes SY1 to SYm and the second sustaining electrodes SZ1 to SZm simultaneously, and TY and TZ drivers 154 and 156 for driving the trigger electrode pairs TY1 to TYm and TZ1 to TZm.

The PDP 150 has a configuration being substantially identical to the PDP 90 shown in FIG. 9.

The X driver 152 applies a data pulse to the data electrodes X1 to Xn in the address interval to select a discharge cell. Then, the X driver 152 applies a positive DC voltage to the data electrodes X1 to Xn in the sustaining interval.

The SY driver 153 applies a negative scanning pulse −Vsc to the first sustaining electrodes SY1 to SYm in the address interval. Also, the SY driver 153 causes a long-path discharge between the sustaining electrode pairs SY1 to SYm and SZ1 to SZm with respect to a discharge cell selected by applying a sustaining pulse in the sustaining interval.

The SZ driver 155 applies a negative scanning pulse −Vsc synchronized with the scanning pulse applied to the first sustaining electrodes SY1 to SYm to the second sustaining electrodes SZ1 to SZm. Also, the SZ driver 155 applies a sustaining pulse to the second sustaining electrodes SZ1 to SZm in the sustaining interval to thereby cause a long-path discharge between the sustaining electrode pairs SY1 to SYm and SZ1 to SZm.

The TY driver 154 applies a trigger pulse in the sustaining interval. The TY driver 154 may generate a scanning pulse −Vsc such that it can be synchronized with the scanning pulse generated from the SZ driver 155. In this case, the SY driver 153 may not generate the scanning pulse −Vsc.

The TZ driver 156 applies a reset pulse for initializing the entire field to the second trigger electrodes TZ1 to TZm in the reset interval and thereafter applies a positive DC voltage to the second trigger electrodes TZ1 to TZm in the address interval. Also, the TZ driver 156 applies a trigger pulse to the 'second trigger electrodes' TZ1 to TZm in the sustaining interval. Herein, a trigger pulse generated from the TZ driver 156 is set to have a lower voltage level than the sustaining pulse. This trigger pulse is responsible for shutting off a discharge between the first trigger electrode TY1 to TYm and the sustaining electrode SY or SZ that weakens the long-path discharge between the sustaining electrode pair SY and SZ.

Figure 16:
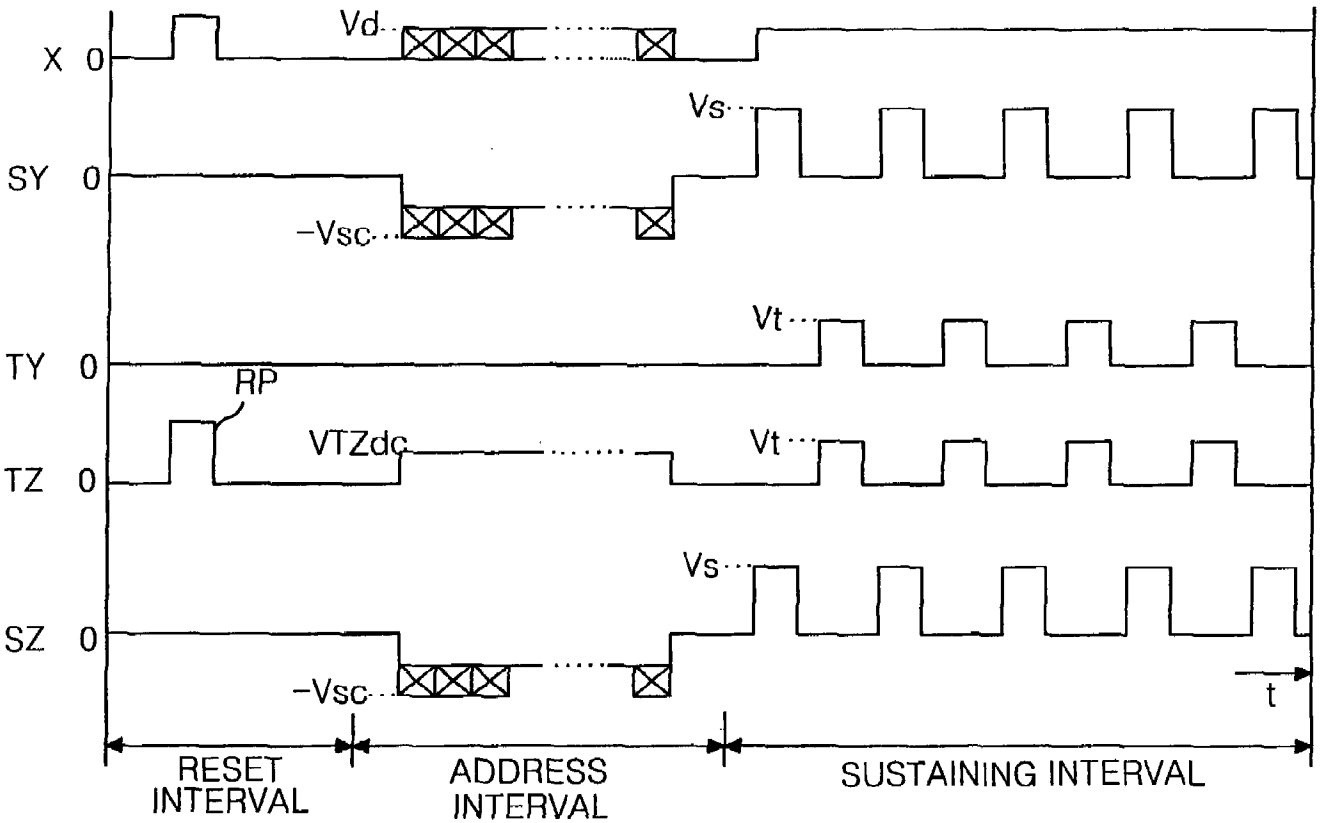
FIG. 16 is a waveform diagram of driving signals for the plasma display panel according to the third embodiment of the present invention.

FIG. 16 shows driving waveforms for explaining a method of driving a PDP according to the third embodiment of the present invention.

Referring to FIG. 16, in the reset interval, a positive reset pulse Vrst having a high voltage level is applied to the second trigger electrode TZ. Then, the discharge cells at the entire field are reset-discharged to left a constant quantity of wall charges at the discharge cells at the entire field. At this time, a positive pulse signal with a low voltage level is applied to the data electrode X so as to prevent an erroneous discharge from being generated between the second trigger electrode TZ and the data electrode X.

In the address interval, a scanning pulse −Vsc is sequentially and simultaneously applied to the sustaining electrode pair SY and SZ. A data pulse Vd synchronized with the scanning pulse −Vsc is simultaneously applied to the data electrodes X. The discharge cell supplied with the data pulse Va causes an address discharge by a voltage difference between the data electrode X and the sustaining electrode pair SY and SZ and an internal wall voltage. By this address discharge, positive wall charges are accumulated in the sustaining electrode pair SY and SZ. At this time, a positive DC voltage VTZdc is applied to the second trigger electrode TZ.

In the sustaining interval, first, a positive sustaining pulse Vs is simultaneously applied to the sustaining electrode pair SY and SZ. At this time, while priming effects caused by wall charges accumulated in the sustaining electrode pair SY and SZ being added to each other, a discharge occurs between the first sustaining electrode SY and the first trigger electrode TY and, at the same time, a discharge occurs between the second sustaining electrode SZ and the second trigger electrode TZ. Since said discharge simultaneously occurring the both sides in this manner causes a discharge at a wide space of the discharge cell, much ultraviolet rays radiates a fluorescent body at a large area. Subsequently, a trigger electrode Vt smaller than the sustaining voltage Vs is simultaneously applied to the trigger electrode pair TY and TZ. At this time, a large quantity of wall charges accumulated in the sustaining electrode pair SY and SZ by the earlier sustaining discharge causes a discharge between the first sustaining electrode SY and the first trigger electrode TY and simultaneously causes a discharge between the second sustaining electrode SZ and the second trigger electrode TZ.

Figure 17:
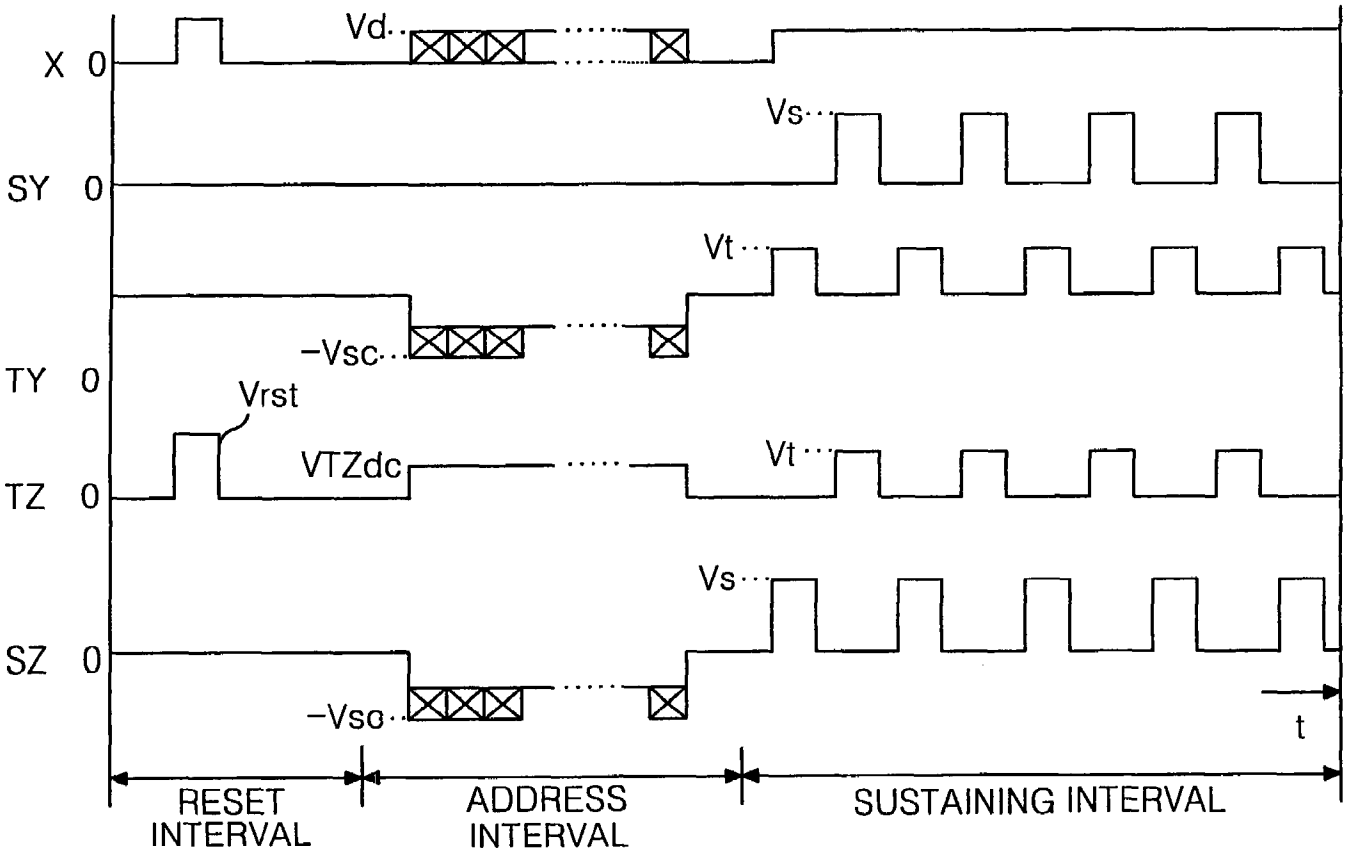
FIG. 17 is a waveform diagram of driving signals for the plasma display panel according to the fourth embodiment of the present invention.

FIG. 17 shows driving waveforms for explaining a method of driving a PDP according to the fourth embodiment of the present invention.

Referring to FIG. 17, in the reset interval, a positive reset pulse Vrst having a high voltage level is applied to the second trigger electrode TZ. Then, the discharge cells at the entire field are reset-discharged to left a constant quantity of wall charges at the discharge cells at the entire field. At this time, a positive pulse signal with a low voltage level is applied to the data electrode X so as to prevent an erroneous discharge from being generated between the second trigger electrode TZ and the data electrode X.

In the address interval, a scanning pulse −Vsc is sequentially and simultaneously applied to the second sustaining electrode SZ and the first trigger electrode TY. A data pulse Vd synchronized with the scanning pulse −Vsc is simultaneously applied to the data electrodes X. The discharge cell supplied with the data pulse Va causes an address discharge. By this address discharge, positive wall charges are accumulated in the second sustaining electrode SZ and the first trigger electrode TY. At this time, a positive DC voltage VTZdc is applied to the second trigger electrode TZ.

In the sustaining interval, first, a sustaining pulse Vs is applied to the second sustaining electrode SZ and, at the same time, a trigger pulse Vt lower than the sustaining voltage Vs is applied to the first trigger electrode TY. At this time, discharges occur between the trigger electrode pair TY and TZ, between the first trigger electrode TY and the first sustaining electrode SY, and between the second trigger electrode TZ and the second sustaining electrode SZ. A long-path discharge is generated between the sustaining electrode pair SY and SZ with the aid of charged particles created by said discharges. Subsequently, a sustaining pulse Vs is applied to the first sustaining electrode SY and, at the same time, a trigger pulse Vt is applied to the second trigger electrode TZ. At this time, only the polarity of wall charges accumulated on each electrode is different from each other. A long-path discharge is generated between the sustaining electrode pair SY and SZ with the aid of the wall charges after a primary discharge occurred between the trigger electrode pair TY and TZ, between the first trigger electrode TY and the first sustaining electrode SY, and between the second sustaining electrode TZ and the second sustaining electrode SZ.

As described above, according to the present invention, a discharge for initiating a long-path discharge is caused between any one of the sustaining electrode pair spaced at a long path and the data electrode opposed vertically thereto, thereby improving efficiency and brightness of the long-path discharge. The long-path discharge is easily induced by a discharge occurring between the data electrode and the sustaining electrode even though a trigger discharge is not generated between the electrode pair spaced at a short path, so that an electrode pair for causing a short-path discharge can be removed from the PDP. Furthermore, a long-path discharge is caused between the sustaining electrode pair SY and SZ by directly utilizing charged particles created by a short-path discharge between the trigger electrode pair without any discharge between the trigger electrode and the sustaining electrode, thereby improving efficiency and brightness of the long-path discharge. In addition, a scanning pulse is simultaneously applied to at least two electrodes to increase a quantity of wall charges formed during the address discharge, thereby easily causing a long-path discharge between the sustaining electrode pair during the sustaining discharge.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. For instance, the skilled person in the art will be able to expect that a width of the scanning electrode in the third-electrode PDP may be enlarged on the basis of the technical idea of the present invention in which a width of the electrode for causing an address discharge is enlarged. Accordingly, the scope of the invention shall be determined only by the appended claims and their equivalents.

What is claimed is:

1. A method of driving a plasma display panel having sustaining electrode pairs and data electrodes and being divided into a reset interval, an address interval and a sustaining interval, the plasma display panel including a first substrate and a second substrate, and the sustaining electrode pairs being provided on the first substrate and the data electrodes being provided on the second substrate, and trigger electrode pairs being provided on the first substrate, said method comprising: applying, during the sustaining interval, sustaining signals to each of the sustaining electrode pair; applying a signal to the data electrode at least during a portion of the sustaining interval in which one of the sustaining signals is applied, wherein a width of the signal applied to the data electrode is greater than a width of one of the sustaining signals, wherein the signal applied to the data electrode has a voltage level greater than ⅓ a voltage level of one of the sustaining signals; and alternately applying a trigger pulse to the electrodes of each trigger electrode pair during the portion of the sustaining interval, the trigger pulse having a lower voltage than the one of the sustaining signals.

2. A method of driving a plasma display panel having sustaining electrode pairs and data electrodes and being divided into a reset interval, an address interval and a sustaining interval, the plasma display panel including a first substrate and a second substrate, and the sustaining electrode pairs being provided on the first substrate and the data electrodes being provided on the second substrate, and trigger electrode pairs being provided on the first substrate, said method comprising: applying, during the sustaining interval, sustaining signals to each of the sustaining electrode pair; applying a signal to the data electrode at least during a portion of the sustaining interval in which one of the sustaining signals is applied, wherein the signal applied to the data electrode has a voltage level greater than ⅓ a voltage level of one of the sustaining signals; and alternately applying a trigger pulse to the electrodes of each trigger electrode pair during the portion of the sustaining interval, the trigger pulse having a lower voltage than the one of the sustaining signals.

3. The method as claimed in claim 2, wherein said signal applied to the data electrode has approximately twice a frequency of one of the sustaining signals.

4. The method as claimed in claim 2, wherein a signal having a lower voltage than one of the sustaining signals is alternately applied to each of an electrode pair positioned at a short path smaller than a long path between the sustaining electrode pair.

5. The method as claimed in claim 2, wherein a width of the signal applied to the data electrode is greater than a width of one of the sustaining signals.

6. The method as claimed in claim 2, wherein a width of the signal applied to the data electrode is approximately twice a width of one of the sustaining signals.

7. The method as claimed in claim 2, wherein the signal applied to the data electrode causes a discharge between the data electrode and one electrode of the sustaining electrode pairs.

8. The method as claimed in claim 2, wherein a distance between trigger electrodes of each trigger electrode pair is smaller than a distance between electrodes of each corresponding sustaining electrode pair.

9. The method as claimed in claim 2, wherein the plasma display panel further includes a plurality of discharge cells with each discharge cell being associated with a corresponding sustaining electrode pair and a corresponding trigger electrode pair.

* * * * *